United States Patent [19]

Schaper et al.

[11] Patent Number: 4,718,945

[45] Date of Patent: Jan. 12, 1988

[54] SUGAR CENTRIFUGE

[75] Inventors: Helmut Schaper, Brunswick; Heinrich Kurland, Erkerode-Lucklum, both of Fed. Rep. of Germany

[73] Assignee: Braunschweigische Maschinenbauanstalt AG, Brunswick, Fed. Rep. of Germany

[21] Appl. No.: 2,956

[22] Filed: Jan. 13, 1987

[30] Foreign Application Priority Data

Jan. 18, 1986 [EP] European Pat. Off. ..... 86710002.6

[51] Int. Cl.[4] ..... C13F 1/06

[52] U.S. Cl. ..... 127/9; 127/19; 127/2; 210/369; 210/380.1; 494/36

[58] Field of Search ..... 127/19, 9, 2; 210/369, 210/380.1; 494/36

[56] References Cited

U.S. PATENT DOCUMENTS

| | | | |
|---|---|---|---|
| 3,302,794 | 2/1967 | Laven | 210/380.1 |
| 3,428,182 | 2/1969 | Hillebrand | 210/369 |
| 3,799,353 | 3/1974 | Pause | 210/369 |
| 3,970,470 | 7/1976 | Trojan et al. . | |
| 4,205,999 | 6/1980 | Zeichner et al. | 210/380.1 |
| 4,308,075 | 12/1981 | Hentschel et al. | 127/19 |
| 4,331,482 | 5/1982 | Schaper | 494/36 |
| 4,409,031 | 10/1983 | Schaper | 210/369 |
| 4,443,266 | 4/1984 | Schaper et al. | 127/19 |

FOREIGN PATENT DOCUMENTS

| | | |
|---|---|---|
| 653051 | 12/1964 | Belgium . |
| 8105054 | 9/1964 | Fed. Rep. of Germany . |

*Primary Examiner*—Andrew H. Metz
*Assistant Examiner*—Chung K. Pak
*Attorney, Agent, or Firm*—W. G. Fasse; D. H. Kane, Jr.

[57] ABSTRACT

A continuously operating sugar centrifugal is equipped with the following components, a massecuite supply device, a frustum-shaped screen drum which is rotatably drivable, a housing surrounding the screen drum, a distributor and accelerating device arranged for cooperation with the screen drum, cover water nozzles arranged in a fixed position in the drum, and an air guide ring. The air guide ring is located at the widening upper open end of the drum. The air guide ring widens conically and forms an extension or elongation of the screen drum. A passage or exit gap for the sugar to be discharged from the drum, is provided between the upper drum edge and a rim of the air guide ring facing the drum. The air guide ring rim facing away from the drum reaches into a ring-shaped air scoop and collecting space (17) which is open toward the interior of the drum.

9 Claims, 2 Drawing Figures

SUGAR CENTRIFUGE

FIELD OF THE INVENTION

The invention relates to a continuously operating sugar centrifugal having a massecuite supply device and a screen drum enclosed by a housing.

DESCRIPTION OF THE PRIOR ART

In such centrifugals the screen drum is driven to rotate about the central axis of the centrifugal. The screen drum has a frustum shape and is equipped with a distribution device and with an acceleration device for uniformly distributing the massecuite onto the drum screen in the bottom zone of the drum. Such centrifugals further comprise nozzles for supplying covering water. These nozzles are arranged in a fixed position inside that part of the drum having a narrower cross-section. Separate collecting and discharge devices are located outside the drum. The collecting device collects the sugar which exits over the drum edge or rim facing toward the open end of the drum. The discharge device discharges the run-off passing through openings in the drum wall for collection in a respective space in the housing.

Sugar centrifugals of the above type are disclosed, for example, in German Utility Model No. 81 05 054. Such conventional centrifugals pose the problem that a substantial proportion of the covering liquid is mechanically atomized in that part of the drum having the narrower cross-section after the covering liquid impacts on the sugar layer. Outside the covering zone located in the narrower part of the drum, the atomized covering liquid again comes into contact with the sugar. As a result of the mechanical atomization of the covering water contaminations on the crystal surfaces of the sugar are entrained into the atomized covering liquid or fog. These contaminations are again deposited on the crystals outside of the covering zone where the fog contacts the crystals. This feature of conventional continuously operating centrifugals impairs the purity of the sugar produced by these centrifugals.

It is known to avoid these disadvantages by equipping the centrifugals with closed covering cowls which are substantially adapted to the screen drum and which rotate with the screen drum. These cowls extend directly from the covering zone to the upper drum edge or rim. Further, the cowls limit or define, together with the drum the sugar exit gap. The gap width of the sugar exit gap corresponds approximately to the thickness of the sugar layer on the screen drum. This approach to the solution of the problem was based on the assumption that a very substantial proportion of the atomized covering water was thrown back onto the sugar layer in an area outside of the covering zone.

However, the covering cowls of the type described have the substantial disadvantage that sugar lumps or temporary small accumulations of sugar crystals which forming the operation of the centrifugal, interfere with the proper operation of the centrifugal because these accumulations or forming clumps of sugar get stuck at the entrance to the gap between the covering cowl and the screen. As a result they cause a localized build-up of the on-flowing sugar crystals. Additionally, these clumps and accumulations cause strip shaped interruptions and thus nonuniformities in the sugar layer flowing to the drum edge or rim. In known centrifugals it cannot be avoided that the sugar clumps being formed travel onto that side of the covering cowl which faces toward the inside of the drum, whereby these clumps are centrifuged off above the covering cowl, or they fall back from the covering cowl into the drum. This type of movement of sugar clumps is a source of trouble and even dangerous.

OBJECTS OF THE INVENTION

In view of the foregoing it is the aim of the invention to achieve the following objects singly or in combination:

to assure an effective and safe separation of the atomized covering water from the sugar in a zone outside of the covering zone;

to assure simultaneously a safe operation of the centrifugal free of trouble even if localized sugar accumulations occur;

to assure such a safe operation of the centrifugal even if clumps are formed which are thicker than the sugar layer;

to guide the air ventilation flow in a sugar centrifugal in a most advantageous manner to avoid the above mentioned problems;

to carry the air ventilation flow in such a way that water droplets and any contaminations contained in the air flow are safely led into areas of the centrifugal where the removal does not pose any problems; and to avoid increasing the overall structural height of the centrifugal, or at least to minimize any height increase.

SUMMARY OF THE INVENTION

The above objects have been achieved according to the invention by providing an air guide ring located at the open, wide end of the drum. The air guide ring also widens in a conical manner and forms an extension of the drum wall or screen. The air guide ring and the drum wall together define a passage gap for the sugar. The rim of the air guide ring facing away from the drum reaches into an air scoop and collecting chamber which is ring-shaped and which is open along the air guide ring toward the inside of the drum.

The invention is based on the recognition or discovery that the generated covering water fog is not thrown back, for all practical purposes, onto the sugar layer outside of the covering zone, but rather is entrained by the air flow that is generated by the ventilation effect of the centrifugal. Thus, a mechanical covering of the sugar layer outside of the covering zone in the centrifugal is not necessary. Rather, it is necessary that the ventilation flow is respectively utilized to assure that the ventilation flow does not come into contact with the sugar that is being centrifuged. The above mentioned features of the air guide ring assure the desired guiding of the ventilating air flow. Thus, the air guide ring leads the ventilation flow in the direction and extension of the drum wall beyond the sugar exit gap and only beyond the sugar exit gap the air guide ring leads the ventilating flow radially outwardly into the ring-shaped air scoop and collecting chamber. Due to this feature of the invention it is now possible to dimension the sugar exit gap between the air guide ring and the open end rim of the drum larger than would be necessary in accordance with the layer thickness of the sugar. This enlarged sugar exit gap width has the advantage that localized crystal accumulations and even sugar lumps up to a predetermined size, can pass through the sugar exit gap without causing any problems. Due to the intensive ventilation flow and due to the air guiding according to the invention also in the zone outside of the drum by the present air guide ring, it has been found that negligibly small quantities, if any, of air enter into the sugar collecting chamber through the sugar exit gap. Thus, these minute air quantities and any fog of covering water that may be entrained in these minute air quantities, do not influence the purity of the centrifuged sugar to any measurable degree.

The ventilation flow is quieted down in the air scoop and collecting chamber, whereby the water fog droplets and contamination entrained in the ventilation flow, are deposited in the collecting chamber, so that their removal out of the air scoop and collecting chamber is possible without any difficulties.

The air guide ring may be a fixed ring located as an axial extension of the drum wall and correspondingly spaced from the wide end drum wall for forming the sugar exit gap. It is, however, especially advantageous if the air guide ring is rigidly secured to the open end rim of the drum at circumferentially spaced spots, whereby the air guide ring rotates with the drum. This embodiment in which the air guide ring rotates with the drum has the advantage that the ventilation flow is supported by the air guide ring and that the air guide ring also performs any unbalanced movements that may be made by the drum, whereby it is avoided that the drum and air guide ring collide with each other.

A prototype of the present centrifuge has been built in which the air guide ring rotates with the drum and the testing operation has shown very satisfactory results.

As mentioned, the air guide ring can form an extension of the drum while leaving the sugar exit gap between the lower rim of the air guide rim and the upper rim of the drum. However, it is quite advantageous if the lower rim of the air guide ring somewhat overlaps the upper rim of the drum still leaving the sugar exit gap between the radially outer surface of the air guide ring and the radially inner surface of the upper rim of the drum. Thus, the lower rim of the air guide ring reaches to some extent into the upper end of the drum. This feature reduces the structural or axial height of the centrifugal. It is also advantageous to make the inner diameter of the upper rim of the drum wider by providing that rim with a step in its cross-section so that the lower end of the air guide ring may reach into said step while still leaving the sugar exit gap open.

BRIEF DESCRIPTION OF THE DRAWINGS

In order that the invention may be clearly understood, it will now be described, by way of example, with reference to the accompanying drawings, wherein.

DETAILED DESCRIPTION OF A PREFERRED EXAMPLE EMBODIMENT

Figure 1:
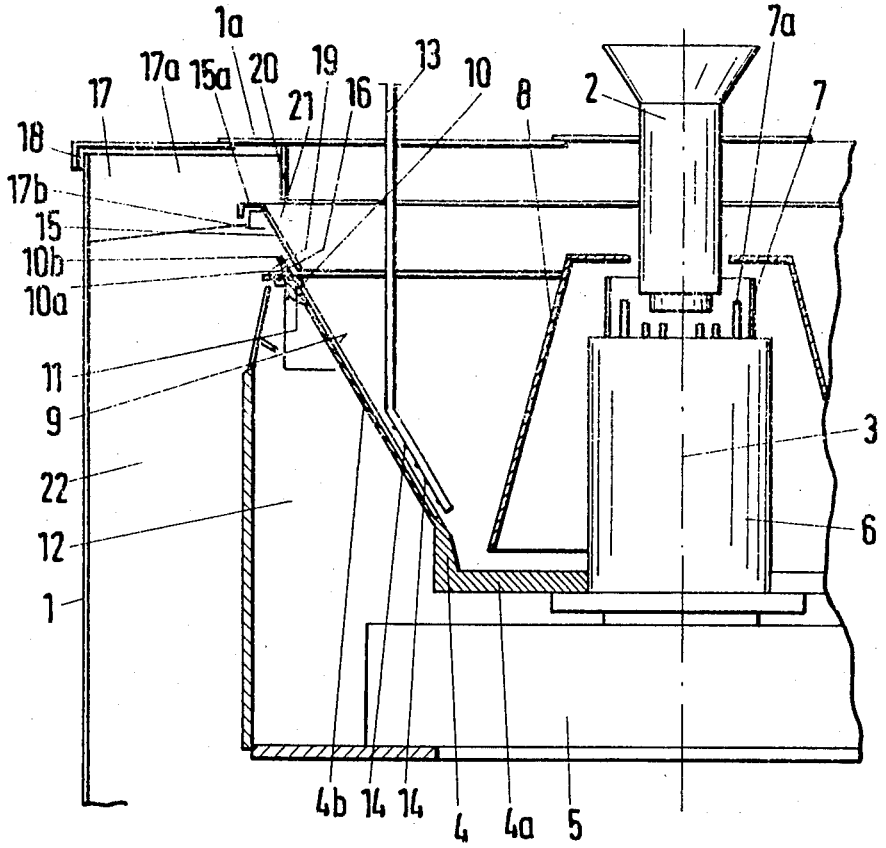
FIG. 1 shows a partial longitudinal section of the centrifugual according to the invention.

The centrifugal shown in the example embodiment has a stationary housing 1 surrounding a rotating screen drum 4 having a central rotational axis 3. The housing 1 is covered by an upper cover wall 1*a* which leaves a labyrinth type gap 18 between the upper edge of the housing 1 and the rim of the cover 1*a* so that the air scoop and collecting chamber 17 is vented to the atmosphere. A massecuite supply tube or funnel 2 passes through the cover 1*a*. Further details of the massecuite supply mechanism are not shown since they are not part of the invention. The screen drum is secured to a hub 6 which in turn is mounted with its respective bearing on a bearing block 5 so that the hub 6 with the screen drum 4 is rotatably drivable by drive means not shown. The screen drum 4 has a bottom section 4*a* connected to the hub 6 and a screen section 4*b* connected to the bottom section 4*a*. The top free end of the hub 6 carries a massecuite distribution and acceleration pot 7 equipped with distribution pins 7*a*. An acceleration bell 8 surrounds the hub 6 with its acceleration pot 7. The lower free rim of the acceleration bell 8 reaches almost down to the bottom 4*a* of the screen drum 4, but leaves a gap for the massecuite to pass out of the acceleration bell 8 and onto the screen section or screen wall 4*b* of the drum 4. The conical screen wall 4*b* carries a screen 9 located on the inside of the screen wall 4*b* and slightly spaced from the screen wall 4*b* to leave a gap between the screen 9 proper and the screen wall 4*b*. A ring element 10 is rigidly secured to the upper end or rim of the drum or rather screen wall 4*b*. The ring element 10 rotates with the drum. The ring element 10 is provided with passage openings 11 for the run-off which is separated from the crystals during the centrifuging of the massecuite. These passages or openings 11 lead into the collecting space 12 for the run-off.

A covering water inlet pipe 13 provided with discharge nozzles 14 along its lower end is held in a fixed position, for example, by being mounted to the cover 1*a*. The covering water discharge nozzles 14 are located in the lower portion of the screen drum section.

According to the invention an air guide ring 15 is located to form an extension or elongation of the wide end of the screen drum section 4*b* of the drum 4. The air guide ring 15 has a conical configuration corresponding to the conical shape of the screen drum section 4*b*. An exit gap 16 for the sugar that is being centrifuged out of the drum is provided between the ring element 10 forming the upper rim of the screen drum section 4*b* and the air guide ring 15.

The air guide ring 15 has a rim portion 15*a* having a radially extending section and a slantedly extending section. This rim 15*a* of the air guide ring 15 reaches into an air scoop and collecting chamber 17 enclosed by the housing 1, by the cover 15*a*, by a skirt 20, and by a bottom wall 17*a* which separates the air scoop and collecting space 17 from the sugar collecting space 22. The skirt 20 is so located, that the air scoop 17 communicates through a gap 21 with the space inside the drum. The scoop 17 is vented to the atmosphere through the labyrinth type gap 18.

The air guide ring 15 is, for example, connected to the upper rim of the drum section at circumferentially spaced points or spots 19. Any conventional connecting means are suitable for the purpose. It is, however, necessary to make sure that the gap 16 for the exit of the sugar is maintained.

In the example embodiment illustrated the upper rim portion of the screen drum section 4*b* formed by the ring element 10 has a stepped configuration. In other words, the inner diameter of the stepped configuration or portion is slightly larger than the inner diameter of the rim forming ring element 10. The stepped portion may also be formed by a ring member 10*a* which has an edge 10*b* over which the sugar is centrifuged to enter into the collecting space 22 as it passes through the gap 16 from the screen drum section 4b.

As shown, the guide ring 15 has a lower portion which has a somewhat smaller outer diameter than the inner diameter of the ring member 10a to form the above mentioned sugar exit gap 16 in the stepped zone of the drum.

Incidentally, the above mentioned skirt 20 is so dimensioned and located that it forms the ring gap 21 between the air scoop and collecting space 17 on the one hand and the interior of the drum 4 on the other hand.

The present centrifugal operates as follows. Massecuite is filled through the funnel 2 into the pot 7 for accelerating the massecuite and uniformly distributing it against the inner wall surface of the bell 8 which further accelerates the massecuite for driving it onto the inner surface of the screen drum 4 in a uniform distribution. The so accelerated and distributed massecuite travels along the screen 9 of the drum 4 to the ring element 10. However, before the massecuite reaches the upper section of the screen drum, covering water is applied through the nozzles 14 of the covering water supply pipe 13.

As the massecuite continues to travel upwardly, the run-off is passing through the run-off openings 11 into the run-off collecting space 12, whereas the sugar remaining on the screen 9 travels through the gap 16 between the air guide ring 15 and the ring element 10. As the leading edge of the sugar being centrifuged passes over the centrifuging edge 10b of the ring member 10a, it enters into the sugar collecting space 22.

When the covering water is sprayed onto the massecuite in the lower portion of the screen drum section 4b, it is unvoidable that the fine water droplets form a fog. According to the invention, this fog is entrained in the ventilation air flow caused by the rotation of the drum 4. This ventilation flow travels approximately in parallel to the screen wall 4b of the drum 4 and passes through the open gap 21 between the air guide ring 15 and the skirt 20 into the air scoop and collecting space 17. This space 17 increases the flow cross-sectional area, whereby the flow is quieted in the space 17 and any entrained liquid particles are deposited in the space 17 from which the collected liquid can be easily removed. The air scoop and collecting space 17 forms a ring channel, the bottom of which is closed by the wall 17a which slants radially outwardly and downwardly. The radially inner rim of the wall 17a forms with the air guide ring 15, a labyrinth type seal. For this purpose the rim 15a of the air guide ring 15 reaching away from the drum 4 has an L-cross-sectional configuration which cooperates with a radially inner rim portion 17b of the wall 17a in the formation of the labyrinth seal. The axially extending portion of the rim 15a of the air guide ring 15 reaches around, with some play, the radially inner rim portion 17b of the wall 17a. The rim portion 17b has a U-shaped cross-sectional configuration.

As mentioned above, the ring gap 18 between the cover 1a and the housing 1 vents the space 17 to the atmosphere so that the ventilation air can leave the space 17, whereby the pressure in the space 17 is reduced while nevertheless permitting the above mentioned separation of the liquid droplets from the ventilating air in the space 17.

Figure 2:
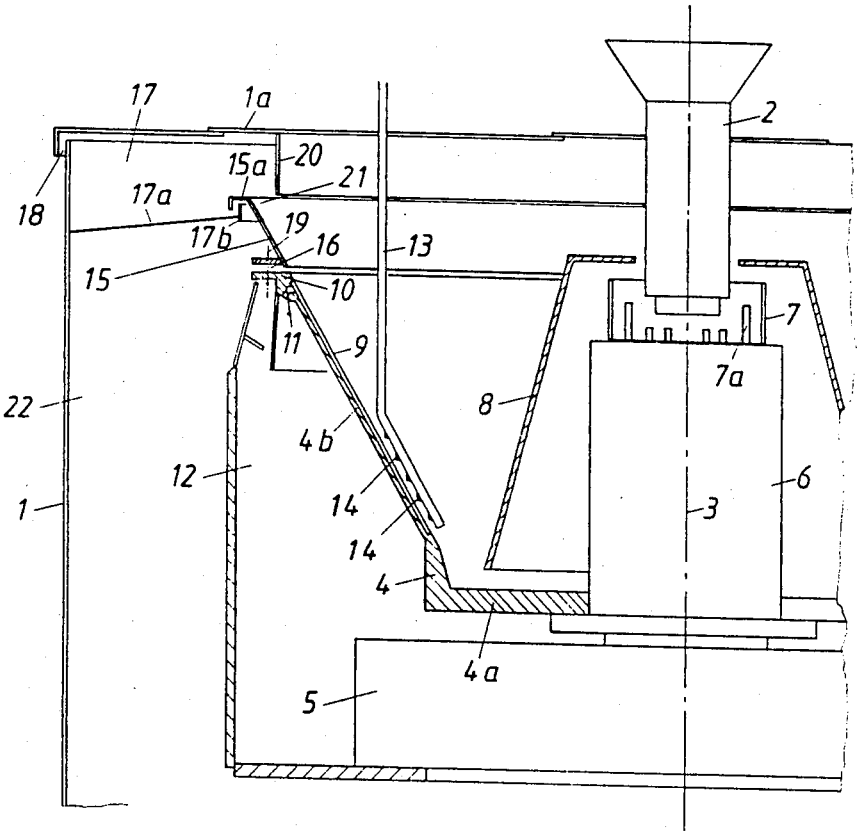
FIG. 2 is a view similar to that of FIG. 1, however, showing an embodiment without a step between the guide ring and the screen.

It has been found that it is not absolutely necessary that the air guide ring 15 reaches in an overlapping manner as shown in FIG. 1 into a stepped upper ring portion of the drum. Rather, the effects intended according to the invention can also be achieved by aligning the inner wall of the air guide ring 15 with the inner wall of the screen drum section 4b while, however, maintaining the sugar exit gap 16 as shown in FIG. 2. However, in any event, the air guide ring 15 must be so arranged that it provides a guide surface for the ventilation air in order to guide the ventilation air into the air scoop and collecting chamber 17.

FIG. 2 is a view similar to that of FIG. 1, however, showing an embodiment without a step between the guide ring 15 and the screen 9.

Although the invention has been described with reference to specific example embodiments, it will be appreciated that it is intended to cover all modifications and equivalents within the scope of the appended claims.

What we claim is:

1. A continuous sugar centrifuge, comprising feeding means for massecuite, a frustum-shaped screen drum (4), a housing (1) surrounding said screen drum, means for driving said screen drum for rotation about its central axis, massecuite distribution and acceleration means arranged centrally in said screen drum for rotation with said screen drum and for uniformly distributing massecuite onto said screen drum in a bottom zone of said screen drum, covering water jets (14) arranged in a fixed position in a narrower cross-sectional zone of said screen drum, separate collection means (22) for sugar exiting over an annular drum edge (10b) near an open drum end, and discharge collecting means (12) for liquid run-off flowing through liquid discharge openings (11) in a drum wall (4b), air guide means for venting air from the screen drum (15) arranged at an open, widened end of said screen drum (4), said air guide means widening conically as an extension of said drum wall (4b), said air guide means defining together with said annular drum edge an annular passage gap (16) for the sugar, said air guide means for venting air from the screen drum having an edge (15a) extending away from said screen drum and reaching into a ring-shaped air scoop and collecting space (17) which is open along the air guide means toward an interior of said screen drum said collecting space being substantially sealed from the collection means (22) such that air flows out of the drum into the collecting space and is vented therefrom.

2. The centrifuge of claim 1, wherein said air guide means comprise an air guide ring (15) rigidly connected to an upper edge of said screen drum (4) at its open end at locations (19) distributed about the circumference of said screen drum upper edge.

3. The centrifuge of claim 1, wherein said air guide means (15) overlap said annular edge of said screen drum (4) at its opening end while leaving open said passage gap (16) for the sugar.

4. The centrifuge of claim 3, wherein said edge, zone of said screen drum (4) has a widened cross-section forming a step said air guide ring means (15) reaching into said step of said widened edge zone.

5. The centrifuge of claim 1, wherein said air guide means comprise an air guide ring (15) having a rim (15a) extending away from said screen drum (4), said rim having an angular rim portion extending in a plane perpendicularly to said central axis (3) of said screen drum, said angular rim portion reaching into said ring-shaped air scoop and collection space (17).

6. The centrifuge of claim 1, wherein said air guide means comprise an air guide ring (15) having a rim extending away from said screen drum (4), said ring having a hook-shaped cross-section reaching into the ring shaped air scoop and collecting space (17).

7. The centrifuge of claim 1, wherein said air guide means comprise an air guide ring having a configuration for covering a cross-section between an interior of said screen drum and said air scoop and collecting space, except for a ring-shaped passage gap (21) for the air flowing out of the inside of said screen drum into said air scoop and collecting space (17).

8. The centrifuge of claim 1, wherein said air scoop and collecting space (17) has an open connection to the atmosphere.

9. The centrifuge of claim 1, wherein said air guide means comprise an air guide ring having a radially inwardly facing conical surface, and wherein said screen drum comprises a screen also having a radially inwardly conical surface, said conical surfaces extending flush with each other.

* * * * *